US010156048B1

(12) United States Patent
Springborg

(10) Patent No.: US 10,156,048 B1
(45) Date of Patent: Dec. 18, 2018

(54) BOOM SCREED CHEMICAL SPRAYER SYSTEM FOR PAVING

(71) Applicant: Chad Springborg, Fort Calhoun, NE (US)

(72) Inventor: Chad Springborg, Fort Calhoun, NE (US)

( * ) Notice: Subject to any disclaimer, the term of this patent is extended or adjusted under 35 U.S.C. 154(b) by 0 days.

(21) Appl. No.: 15/471,312

(22) Filed: Mar. 28, 2017

(51) Int. Cl.

| | |
|---|---|
| ***E01C 19/42*** | (2006.01) |
| ***B05B 13/00*** | (2006.01) |
| ***B05B 9/00*** | (2006.01) |
| ***E01C 19/16*** | (2006.01) |
| ***E01C 19/40*** | (2006.01) |
| ***B05B 9/04*** | (2006.01) |
| ***B05B 12/00*** | (2018.01) |

(52) U.S. Cl.
CPC ..... *E01C 19/42* (2013.01); *B05B 9/007* (2013.01); *B05B 9/0423* (2013.01); *B05B 12/002* (2013.01); *B05B 13/005* (2013.01); *E01C 19/16* (2013.01); *E01C 19/40* (2013.01); *E01C 2301/40* (2013.01)

(58) Field of Classification Search
CPC ..... E01C 19/42; E01C 19/40; E01C 19/16; E01C 19/17; E01C 19/172; E01C 19/174; E01C 19/176; E01C 2301/40; E01C 19/006; E01C 19/405; B05B 9/007; B05B 9/0423; B05B 12/002; B05B 13/005; E04G 21/066; E04F 21/247
See application file for complete search history.

(56) References Cited

U.S. PATENT DOCUMENTS

| | | | | |
|---|---|---|---|---|
| 3,550,854 A * | 12/1970 | Fischer | A01M 7/0089 | 239/124 |
| 4,213,796 A * | 7/1980 | Shaffer | B08B 3/026 | 134/26 |
| 5,279,500 A * | 1/1994 | Perrin | E01C 19/176 | 404/111 |
| 5,988,528 A * | 11/1999 | Krohn | A01M 7/0075 | 239/168 |
| 6,161,775 A * | 12/2000 | Brown | B05B 9/0423 | 239/132.1 |
| 6,499,670 B1 * | 12/2002 | Brown | E01C 19/174 | 137/627.5 |
| 7,438,764 B1 * | 10/2008 | Hill | E01C 19/176 | 118/313 |

(Continued)

OTHER PUBLICATIONS

Nox-Crete Products Group, Monofilm Surface Evaporation Reducer Product Data, www.nox-crete.com, Mar. 23, 2016, 2 pages.

(Continued)

*Primary Examiner* — Abigail A Risic
(74) *Attorney, Agent, or Firm* — Suiter Swantz pc llo

(57) ABSTRACT

A boom screed machine including a chemical spray system. The boom screed machine includes a platform assembly, a boom, a vertical column, a plow head crossbar, a plow head, a tank, a pump, platform assembly tubing, a pressure regulating valve, a chemical spray fluid hose, a reel system, plow head crossbar tubing, a solenoid valve, and a spray head. The pump is configured to receive the chemical spray fluid and pump the chemical spray fluid through the platform assembly tubing, the chemical spray fluid hose, the plow head crossbar tubing, and the spray head when the solenoid valve is open and the pump is activated.

17 Claims, 11 Drawing Sheets

(56) References Cited

U.S. PATENT DOCUMENTS

| | | | | |
|---|---|---|---|---|
| 7,854,565 | B2 * | 12/2010 | Halonen | E01C 19/006 404/114 |
| 8,684,717 | B2 * | 4/2014 | Kim | E04F 21/241 33/526 |
| 9,051,696 | B1 * | 6/2015 | Coats | B62D 11/003 |
| 2004/0135003 | A1 * | 7/2004 | Wilting | A01M 7/0089 239/124 |
| 2006/0018715 | A1 * | 1/2006 | Halonen | E01C 19/006 404/118 |
| 2014/0353394 | A1 * | 12/2014 | Foster | B05B 13/005 239/1 |
| 2017/0182954 | A1 * | 6/2017 | Fais | F16M 13/022 |

OTHER PUBLICATIONS

Somero Enterprises, Inc., S-22E, flyer, www.somero.com, Jan. 2017, 2 pages.

* cited by examiner

BOOM SCREED CHEMICAL SPRAYER SYSTEM FOR PAVING

BACKGROUND

Boom screed machines are used in the paving process to level wet concrete. Boom screed machines include a retractable and extendable boom and a plow head. Extending the boom pushes the plow head over the wet concrete to create a level and smooth surface on the wet concrete.

Chemical sprays, such as evaporation retardants, are often applied to the level and smooth wet concrete to create a protective layer on top of the level and smooth wet concrete. Such, chemical sprays prolong the amount of time available for concrete finishing and also reduce the possibility of surface crusting, surface cracking, and spalling. Typically, such chemical sprays are manually applied to level and smooth wet concrete by handheld sprayers.

SUMMARY

In one aspect, embodiments of the inventive concepts disclosed herein are directed to a boom screed machine including a chemical spray system. The boom screed machine includes a platform assembly, a boom, a vertical column, a plow head crossbar, a plow head, a tank, a pump, platform assembly tubing, a pressure regulating valve, a chemical spray fluid hose, a reel system, plow head crossbar tubing, a solenoid valve, and a spray head. The boom is configured to extend and retract and is coupled to the platform assembly. The vertical column is coupled to an end of the boom. The plow head crossbar is coupled to the vertical column. The plow head is coupled to the plow head crossbar and is configured to smooth and level wet concrete when the boom is extended. The tank is implemented in or on the platform assembly. The pump is implemented in or on the platform assembly. The platform assembly tubing connects the tank to the pump. The pressure regulating valve is connected to the platform assembly tubing and is configured to control a rate of a flow through the platform assembly tubing. The chemical spray fluid hose is coupled to the platform assembly tubing and passes through the boom. The reel system is implemented in the boom and is configured to accommodate the chemical spray fluid hose. The plow head crossbar tubing is mounted to the plow head crossbar and is coupled to the chemical spray fluid hose. The solenoid valve is connected to the plow head crossbar tubing. The solenoid valve is configured to open and close a flow through the plow head crossbar tubing. The spray head is coupled to the plow head crossbar tubing and is configured to spray chemical spray fluid onto level and smooth wet concrete. The pump is configured to receive the chemical spray fluid and pump the chemical spray fluid through the platform assembly tubing, the chemical spray fluid hose, the plow head crossbar tubing, and the spray head when the solenoid valve is open and the pump is activated.

In a further aspect, embodiments of the inventive concepts disclosed herein are directed to a chemical spray system kit configured to be installed on a boom screed machine. The kit includes a tank, a pump, platform assembly tubing, a pressure regulating valve, a chemical spray fluid hose, plow head crossbar tubing, a solenoid valve, and a spray head. The tank is configured to be implemented in or on a platform assembly of the boom screed machine. The pump is configured to be implemented in or on the platform assembly. The platform assembly tubing is configured to connect the tank to the pump and is configured to be implemented on the platform assembly. The pressure regulating valve is configured to connect to the platform assembly tubing and is configured to control a rate of a flow through the platform assembly tubing. The chemical spray fluid hose is configured to be coupled to the platform assembly tubing and is configured to pass through a boom of the boom screed machine. The plow head crossbar tubing is configured to mount to a plow head crossbar of the boom screed machine and is configured to couple to the chemical spray fluid hose. The solenoid valve is configured to connect to the plow head crossbar tubing and is configured to open and close a flow through the plow head crossbar tubing. The spray head is configured to couple to the plow head crossbar tubing and is configured to spray chemical spray fluid onto level and smooth wet concrete.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
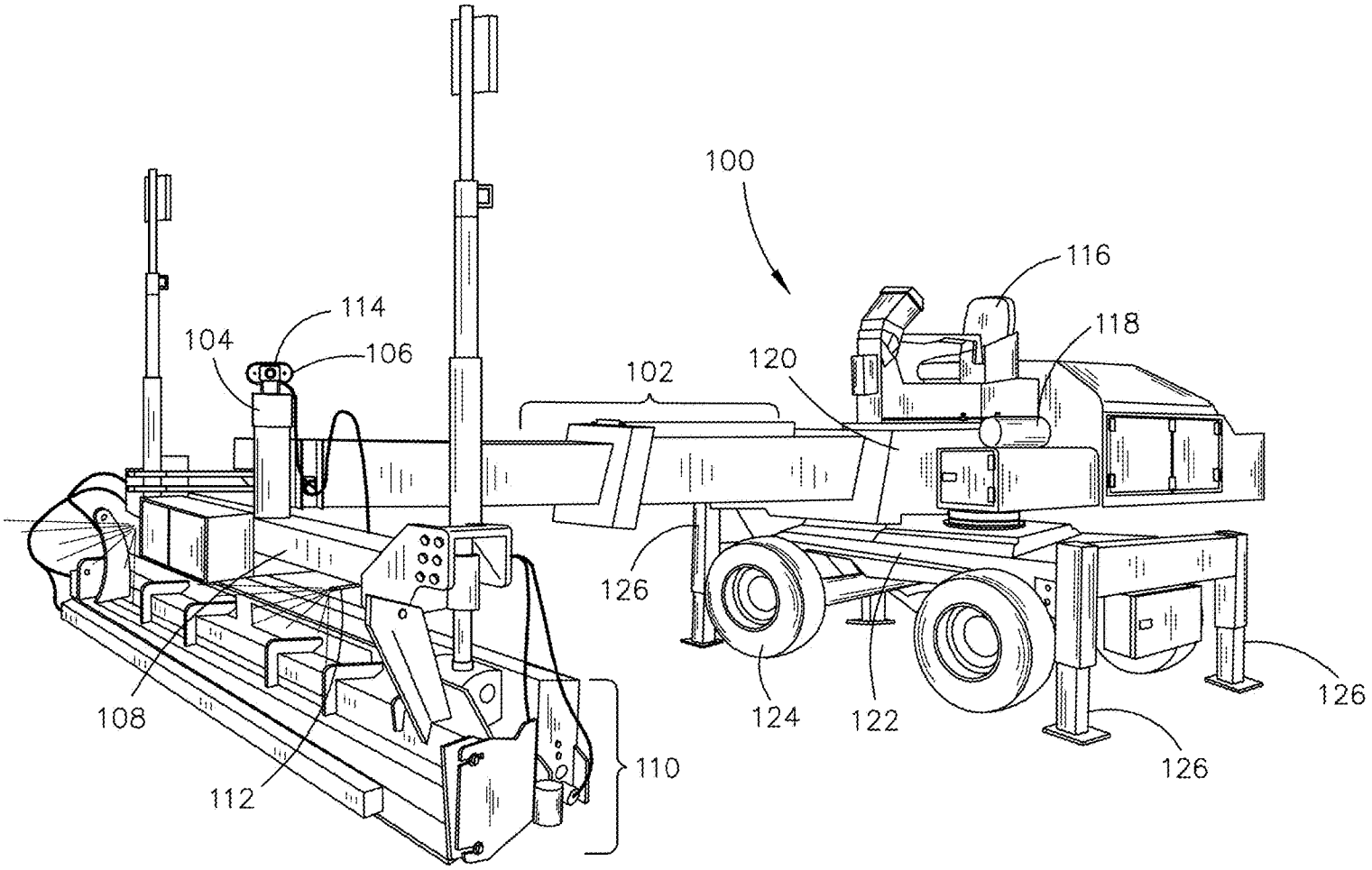
FIG. 1 is a view of an exemplary embodiment of a boom screed machine including a chemical sprayer system configured to spray chemicals according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Referring now to FIG. 1, an exemplary embodiment of a boom screed machine 100 according to the inventive concepts disclosed herein includes a chemical sprayer system configured to spray chemicals, such as evaporation retardant, onto the surface of level and smooth wet concrete to prolong the amount of time available for concrete finishing and also to reduce the possibility of surface crusting, surface cracking, and spalling.

The boom screed machine 100 may include a retractable and extendable boom 102, a vertical column 104, a loop 106, a plow head crossbar 108, a plow head 110, spray heads 112, a camera 114, an operator seat 116, a chemical tank 118, a platform assembly 120, a base assembly 122, wheels 124, and stabilizing legs 126.

The base assembly 122 of the boom screed machine 100 is supported by the wheels 124. The stabilizing legs 126 may be extended toward the ground to provide additional stability for the boom screed machine 100. The platform assembly 120 is rotatably coupled to the base assembly 122 via a vertical shaft such that the platform assembly may rotate about the vertical shaft relative to the base assembly 122. The operator seat 116 and the chemical tank 118 may be mounted to the platform assembly 120. For example, the operator seat 116 may be positioned above and behind the boom 102 facing down the length of the boom 102 such that an operator has a line of sight down the boom 102 and toward the plow head 110. For example, the chemical tank 118 may be positioned at a flat front corner area of the platform assembly such that the chemical tank 118 is positioned near and to the side of an attachment point of the boom 102 to the platform assembly 120.

A first end of the boom 102 may be coupled to (e.g., mounted on, bolted to, welded to, attached to, affixed to, and/or inserted in) the platform assembly 120. The boom 102 may be configured to extend and retract (e.g., hydraulically extend and retract). A hose (e.g., 202) for chemical spray fluid, a cable for the camera, and wiring for a solenoid valve (e.g., 206), as well as other hoses or cables, may pass through hollow portions of the boom 102. A second end of the boom 102 may be coupled to a portion (e.g., a side portion or top portion) of the vertical column 104. The loop 106 may be coupled to a top portion of the vertical column 104. The loop 106 may provide a central and elevated location for the camera 114 to be positioned such that the camera 114 is away from possible splatter that can sometimes occur during paving construction operations.

A bottom portion of the vertical column 104 may be coupled to the plow head crossbar 108. The plow head crossbar 108 may be configured to rotate about a vertical axis passing through the vertical column 104 such that the plow head crossbar 108 can be positioned perpendicular to the boom 102 or rotated such that the plow head crossbar 108 is approximately parallel to the boom 102.

Piping (e.g., 212) for the chemical sprayer system may be coupled, such as via hangers (e.g., 208), to the side and/or underside of the plow head crossbar 108. Spray heads 112 may be coupled to the piping (e.g., 212). The spray heads 112 may be configured to spray chemicals, such as evaporation retardant, supplied from the piping (e.g., 212) and the hose 202 onto the smooth and level wet concrete.

The plow head 110 may be coupled to the plow head crossbar 108 such that the plow head 110 is positioned below and approximately parallel to the plow head crossbar 108. The plow head 110 may be configured to smooth and level wet concrete as the boom 102 is extended.

The camera 114 may be coupled to the loop 106 and/or to the vertical column 104. The camera 114 may be communicatively coupled (e.g., coupled via a wireless or wired connection) with a display (e.g., 504), a controller (e.g., 802), and/or another device (e.g., a computing device including a processor or a networked device). For example, the camera 114 may be configured to capture images and/or video in front of the plow head 110 and provide the images and/or video to the display (e.g., 504) and/or the controller (e.g., 802). For example, the camera 114 may be configured to capture video of the unsmoothed and unleveled wet concrete as the boom 102 extends and capture images and/or video of smooth and level wet concrete, as well as coverage of sprayed-on evaporation retardant as the boom 102 retracts. For example, the camera may be configured to capture video of portions of the level and smooth wet concrete lacking evaporation retardant and supply such video to the display (e.g., 504).

The boom screed machine 100 may be configured to extend the boom 102 to push the plow head 110 over and/or through the wet concrete to create a level and smooth surface on the wet concrete. Additionally, the boom screed machine 100 may be configured to raise the plow head 110 above (e.g., slightly above, such as one or more inches above) the level and smooth wet concrete and to retract the boom 102. Further, for example, while the boom 102 is being retracted, the chemical sprayer system of the boom screed machine 100 may be configured to spray chemicals, such as evaporation retardant, through one or more (e.g., one, two, three, or more) spray heads 112 onto the level and smooth wet concrete. Once a section of wet concrete is smoothed and treated with chemicals, the boom screed machine 100 may be repositioned so as to smooth and chemically treat another section of wet concrete.

While FIG. 1 exemplarily includes elements as shown, in some embodiments, one or more of the elements of the boom screed machine 100 may be omitted, or the boom screed machine 100 may include other elements. Additionally, while FIG. 1 exemplarily includes the depicted arrangement of elements as shown, in some embodiments, one or more of the elements of the boom screed machine 100 may have a different arrangement.

Figure 2:
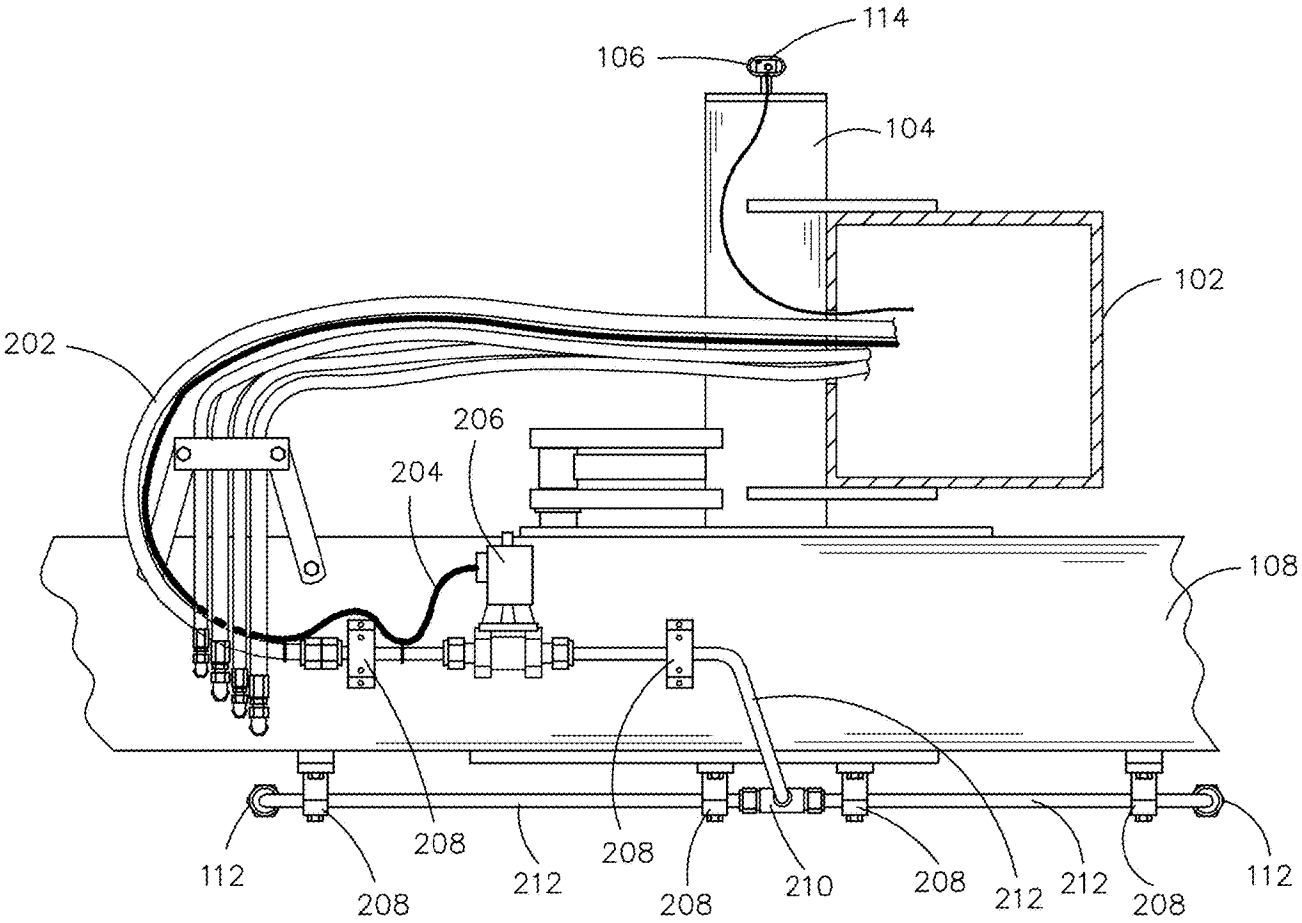
FIG. 2 is a view of a portion of the chemical spray system of the boom screed machine of FIG. 1.

Referring now to FIG. 2, a view of a portion of the chemical spray system of the boom screed machine 100 of an exemplary embodiment according to the inventive concepts disclosed herein is depicted.

As shown in FIG. 2, the chemical spray system of the boom screed machine 100 may include the camera 114, a hose 202 for chemical spray fluid, at least one cable 204 (e.g., at least one wire) for the solenoid valve 206, at least one cable (e.g., at least one wire) for the camera 114, the solenoid valve 206, piping 212 for the chemical spray fluid, at least one tee 210, hangers 208, and the spray heads 112.

The hose 202 for the chemical spray fluid, the cable for the camera 114, and the cable 204 for the solenoid valve 206 may pass through hollow portions of the boom 102. The hose 202 for the chemical spray fluid, the cable for the camera 114, and the cable for the solenoid valve 206 may have sufficient slack to allow for repositioning the plow head 110 and for extending and retracting the boom 102.

An end of the hose 202 may be coupled to the piping 212. The piping 212 for the chemical sprayer system may be coupled, such as via hangers 208, to the side (e.g., a rear side perpendicular to and facing the boom 102 when the plow head crossbar 108 is perpendicular to the boom 102) and/or underside of the plow head crossbar 108. The spray heads 112 may be coupled to the piping 212. The spray heads 112 may be configured to spray chemicals, such as evaporation retardant, supplied from the piping 212 and the hose 202 onto the smooth and level wet concrete, such as when the boom is retracting.

The solenoid valve 206 may be installed between sections of the piping 212. For example, the solenoid valve 206 may installed on the rear side (perpendicular to and facing the boom 102 when the plow head crossbar 108 is perpendicular to the boom 102) of the plow head crossbar 108. The piping 212 and solenoid valve 206 may be installed and positioned such that the piping 212 and solenoid valve 206 are not damaged when the plow head crossbar 108 is rotated toward the boom 102, such as for storage or transportation of the boom screed machine 100. Additionally, the location of the solenoid valve 206 near the spray heads (e.g., on the plow head crossbar 108) prevents and/or reduces (e.g., minimizes) chemical spray fluid from dripping onto the smooth and level wet concrete when shutting off flow of the spray. The solenoid valve 206 may be coupled to the cable 204. The cable 204 may be configured to power and/or transmit control signals to the solenoid valve 206. For example, the solenoid valve 206 may be configured to open and close based on a control signal or electrical power received via the cable 204. When the solenoid valve 206 is open, the solenoid valve 206 may be configured to allow chemical spray fluid to flow through the piping 212 and the spray heads 112 such that the chemical spray fluid is sprayed onto the smooth and level wet concrete. While the piping 212 is shown and described as piping, in some embodiments, the piping 212 may be implemented as any suitable tubing, such as piping or hose. When a pump (e.g., 608) of the chemical spray system is activated and when the solenoid valve 206 is open, the chemical spray system sprays the chemical spray fluid through the spray heads 112 onto the smooth and level wet concrete. Similarly, when the pump (e.g., 608) of the chemical spray system is deactivated and/or when the solenoid valve 206 is closed, the chemical spray system will not spray the chemical spray fluid through the spray heads 112.

While FIG. 2 exemplarily includes elements as shown, in some embodiments, one or more of the elements of the boom screed machine 100 may be omitted, or the boom screed machine 100 may include other elements. For example, in some embodiments, the chemical spray system may include a different number of spray heads 112, such as 1, 3, 4, or more spray heads 112. Additionally, while FIG. 2 exemplarily includes the depicted arrangement of elements as shown, in some embodiments, one or more of the elements of the boom screed machine 100 may have a different arrangement.

Figure 3:
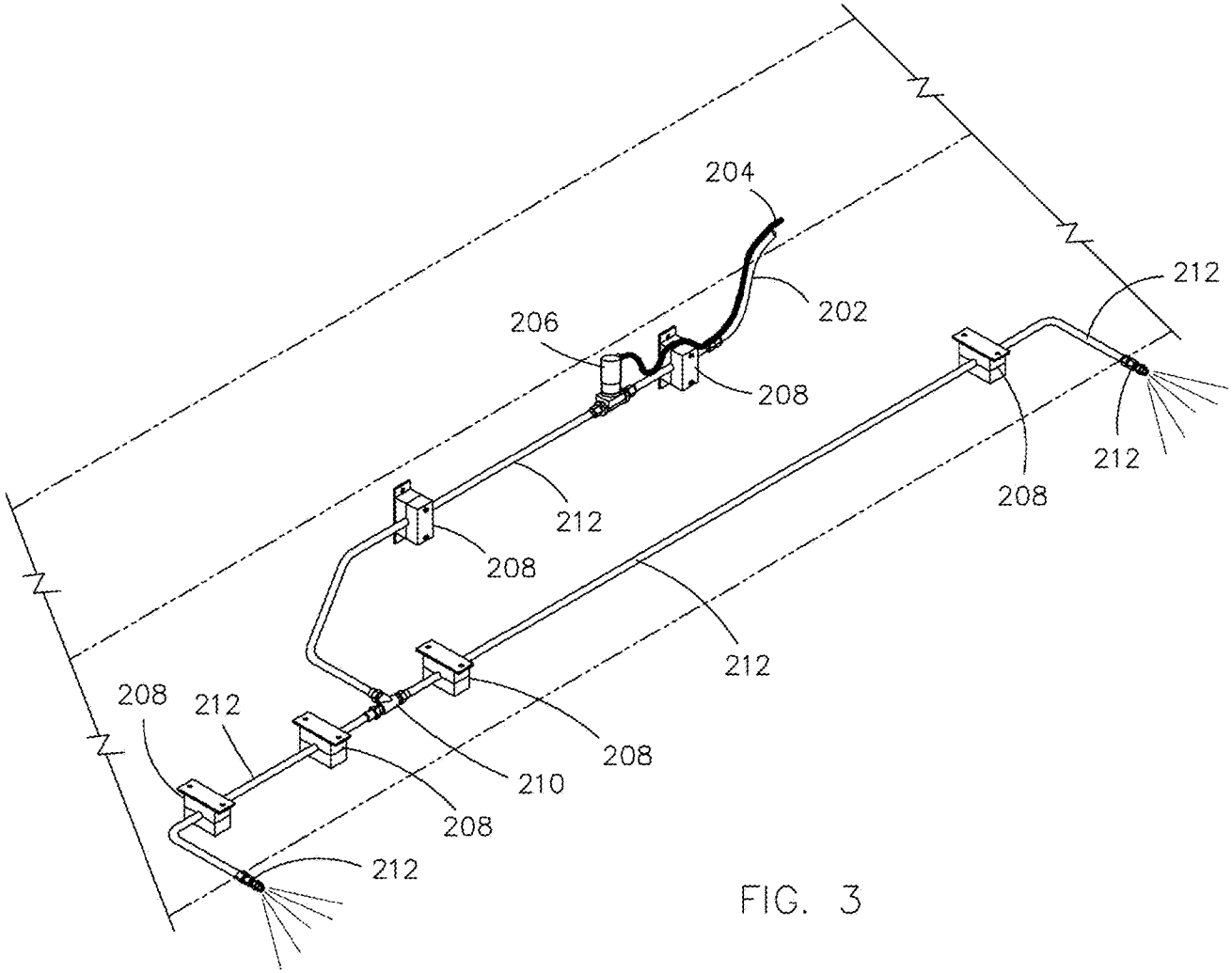
FIG. 3 is an isometric view of a portion of the chemical spray system of the boom screed machine of FIG. 1.

Referring now to FIG. 3, an isometric view of a portion of the chemical spray system of the boom screed machine 100 of an exemplary embodiment according to the inventive concepts disclosed herein is depicted.

Figure 4A:
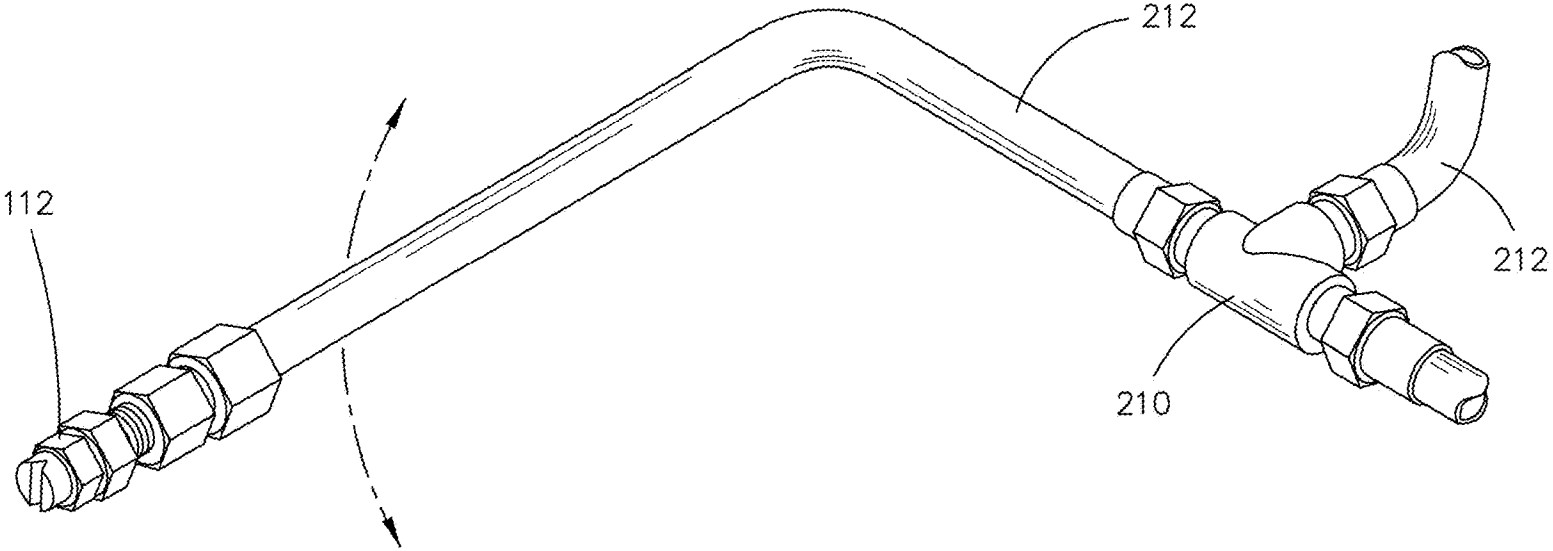
FIG. 4A is an isometric view of a portion of the chemical spray system of the boom screed machine of FIG. 1.

Referring now to FIG. 4A, an isometric view of a portion of the chemical spray system of the boom screed machine 100 of an exemplary embodiment according to the inventive concepts disclosed herein is depicted. As shown in FIG. 4A, an aim of each of the spray heads 112 may be adjustable such as by turning the piping 212 connected to the spray heads 112 up or down. As such, the spray heads 112 are configured to be aimed vertically and/or horizontally to accommodate various job-site conditions (e.g., concrete thickness and/or surface slope), weather conditions (e.g., wind conditions), and/or operating conditions (e.g., flow rate through the spray heads 112).

Figure 4B:
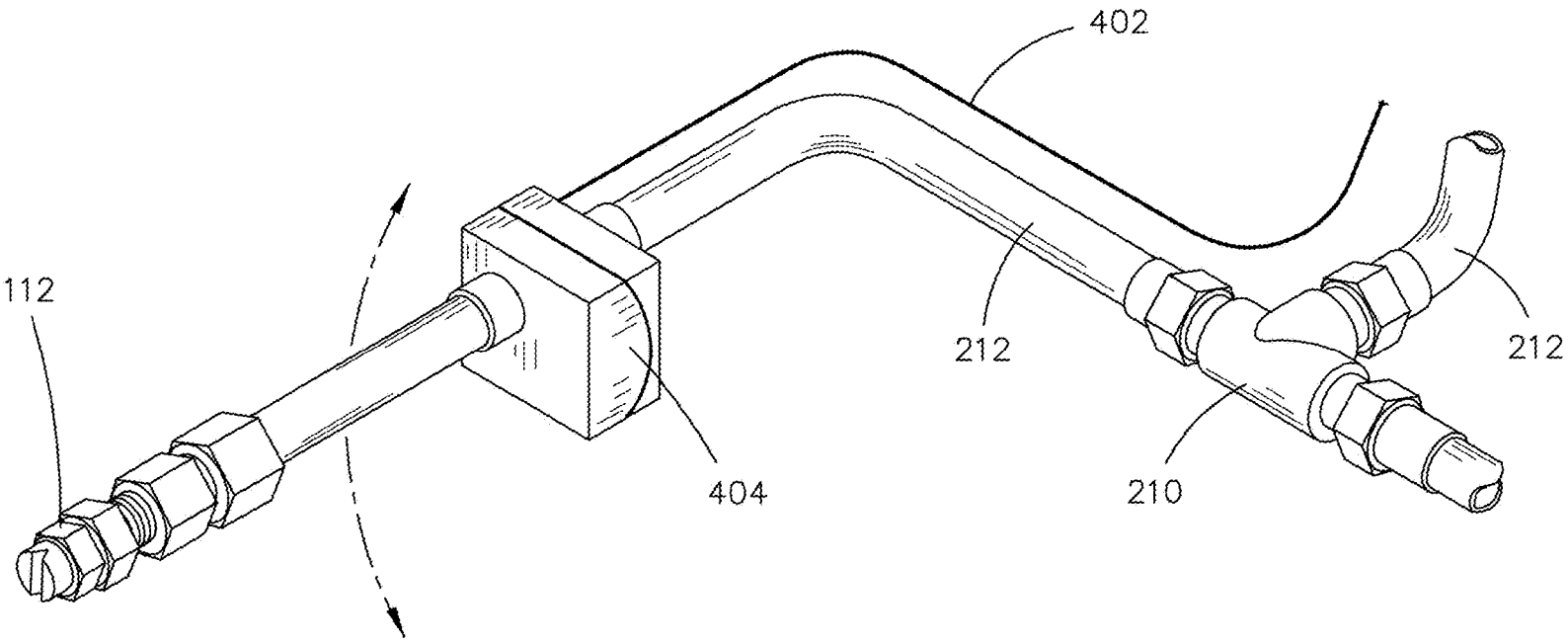
FIG. 4B is an isometric view of a portion of the chemical spray system of the boom screed machine of FIG. 1.

Referring now to FIG. 4B, an isometric view of a portion of the chemical spray system of the boom screed machine 100 of an exemplary embodiment according to the inventive concepts disclosed herein is depicted. As shown in FIG. 4, the chemical spray system may include one or more pivot actuators (e.g., spray aim motorized actuator 404) configured to move the spray direction of each spray head 112. Each of the one or more pivot actuators may be powered by and/or controlled via a cable 402 (e.g., a wire), which may, for example, be coupled to a controller (e.g., 802) or control switch. Each of the pivot actuators may be configured to adjust an aim of a spray head 112. As such, the spray heads are 112 are configured to be aimed vertically and/or horizontally to accommodate various job-site conditions (e.g., concrete thickness and/or surface slope), weather conditions (e.g., wind conditions), and/or operating conditions (e.g., flow rate through the spray heads 112).

Figure 5:
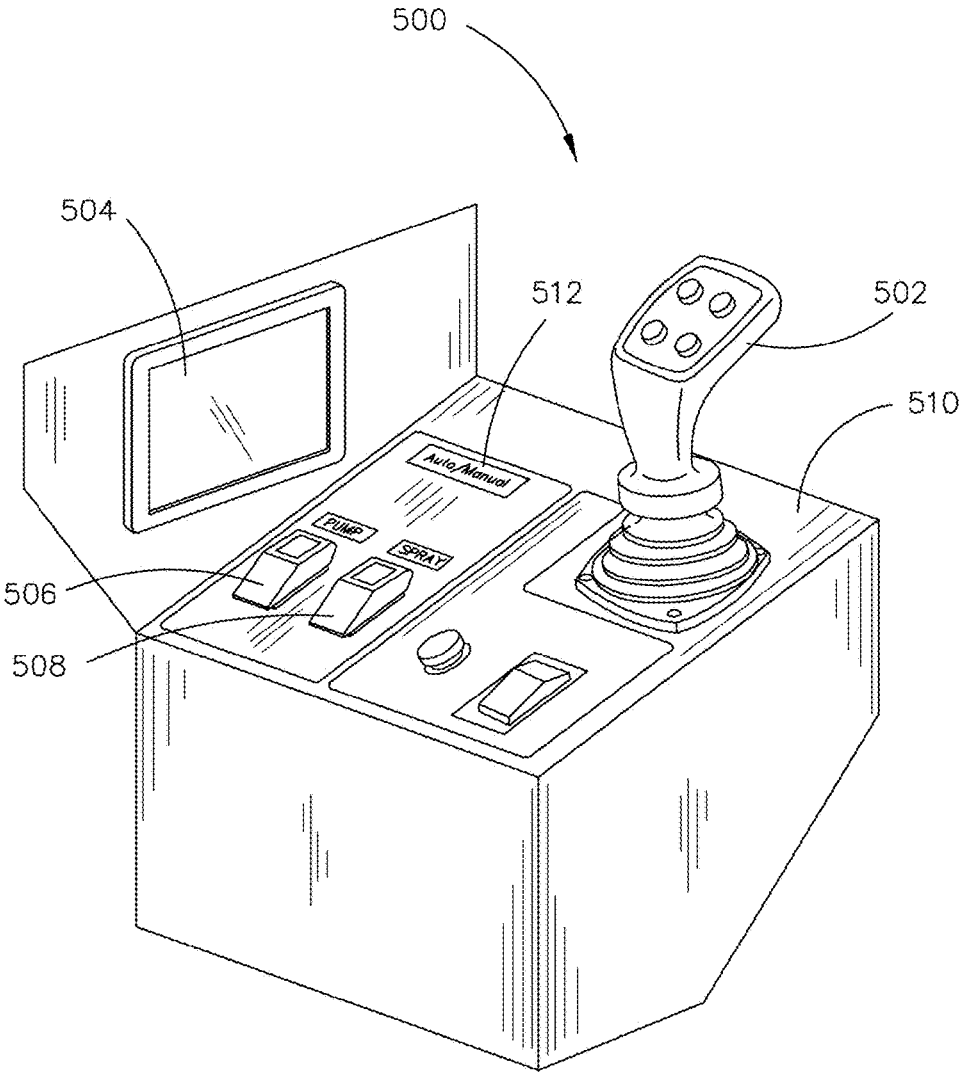
FIG. 5 is an isometric view of an exemplary control panel of the chemical spray system of the boom screed machine of FIG. 1.

Referring now to FIG. 5, an isometric view of an exemplary control panel 500 of the chemical spray system of the boom screed machine 100 of an exemplary embodiment according to the inventive concepts disclosed herein is depicted. The control panel 500 may include a display 504, a plurality of user input control devices, and a housing 510. The plurality of user input control devices may be implemented as any suitable user input control devices configured to interface with a user. Exemplary user input control devices may include buttons, knobs, toggle switches, touchscreen buttons (e.g., graphical user interface buttons implemented on a touchscreen display), a voice recognition system (e.g., comprising a microphone, a processor, and memory) and/or joysticks. For example, the plurality of user input control devices may be implemented as a joystick 502, a pump user input switch 506, a spray user input switch 508, and an automatic/manual button 512.

The joystick 502 may be configured to control retraction and extension of the boom 102, a direction of rotation of the platform assembly 120 relative to the base assembly 122, and direction of movement of the boom screed machine 100. Additionally, the joystick 502 may include buttons configured to perform any of various operations.

The display 504 may be configured to display images and/or video captured by the camera 114 as well as display any of various graphical user interfaces associated with the boom screed machine 100 and/or the chemical spray system. For example, the display 504 may be configured to display video of the unsmoothed and unleveled wet concrete as the boom 102 extends and display video of smooth and level wet concrete, as well as coverage of sprayed-on evaporation retardant, as the boom 102 retracts.

The pump user input switch 506 may be configured to activate and deactivate a pump (e.g., 608) of the chemical spray system. The spray user input switch 508 may be configured to open and close the solenoid valve 206 of the chemical spray system. When a pump (e.g., 608) of the chemical spray system is activated and when the solenoid valve 206 is open, the chemical spray system sprays the chemical spray fluid through the spray heads 112 onto the smooth and level wet concrete. Similarly, when the pump (e.g., 608) of the chemical spray system is deactivated and/or when the solenoid valve 206 is closed, the chemical spray system will not spray the chemical spray fluid through the spray heads 112.

The automatic/manual button 512 may be configured to switch the chemical spray system between operating in a manual mode or an automatic mode. When in manual mode, the operator of the boom screed machine 100 may operate the chemical spray system by manually interfacing with the pump user input switch 506 to activate or deactivate the pump (e.g., 608), the spray user input switch 508 to open or close the solenoid valve 206, and the joystick 502 to control the extension or retraction of the boom 102. For example, in manual mode, the operator may extend the boom 102 to level and smooth wet concrete by interfacing with the joystick 502, and then, the operator may activate the pump (e.g., 608), via the pump user input switch 506, open the solenoid valve 206, via the spray user input switch 508, and retract the boom 102 by interfacing with the joystick 502. When the chemical spray fluid covers the intended area, the operator may deactivate the pump, via the pump user input switch 506 and close the solenoid valve 206, via the spray user input switch 508.

Additionally, the operator of the boom screed machine 100 may activate the automatic mode of the chemical spray system by interfacing with (e.g., pressing) the automatic/manual button 512. When in automatic mode, the pump (e.g., 608) and the solenoid valve 206 may be synchronously controlled automatically based on whether the boom 102 is extending, stationary, or retracting. For example, when the boom 102 is stationary or extending, the pump (e.g., 608) may be deactivated and the solenoid 206 may be closed such that the chemical spray system is not spraying the chemical spray fluid. Additionally, for example, when the boom 102 is retracting, the pump (e.g., 608) may be activated and the solenoid 206 may be open such that the chemical spray system sprays the chemical spray fluid as the boom 102 is retracting. In some embodiments, when operating in automatic mode, the pump (e.g., 608) may remain activated and the solenoid 206 may remain open for a predetermined amount of time (e.g., 0.1 seconds, 0.5 seconds, one second, two seconds, or more) after the boom 102 ceases to retract.

While FIG. 5 exemplarily includes elements as shown, in some embodiments, one or more of the elements of the control panel 500 may be omitted, or the control panel may include other elements. Additionally, while FIG. 5 exemplarily includes the depicted arrangement of the plurality of user input control devices as shown, in some embodiments, one or more of the plurality of user input control devices may be implemented as any suitable user input control device in any suitable arrangement.

Figure 6A:
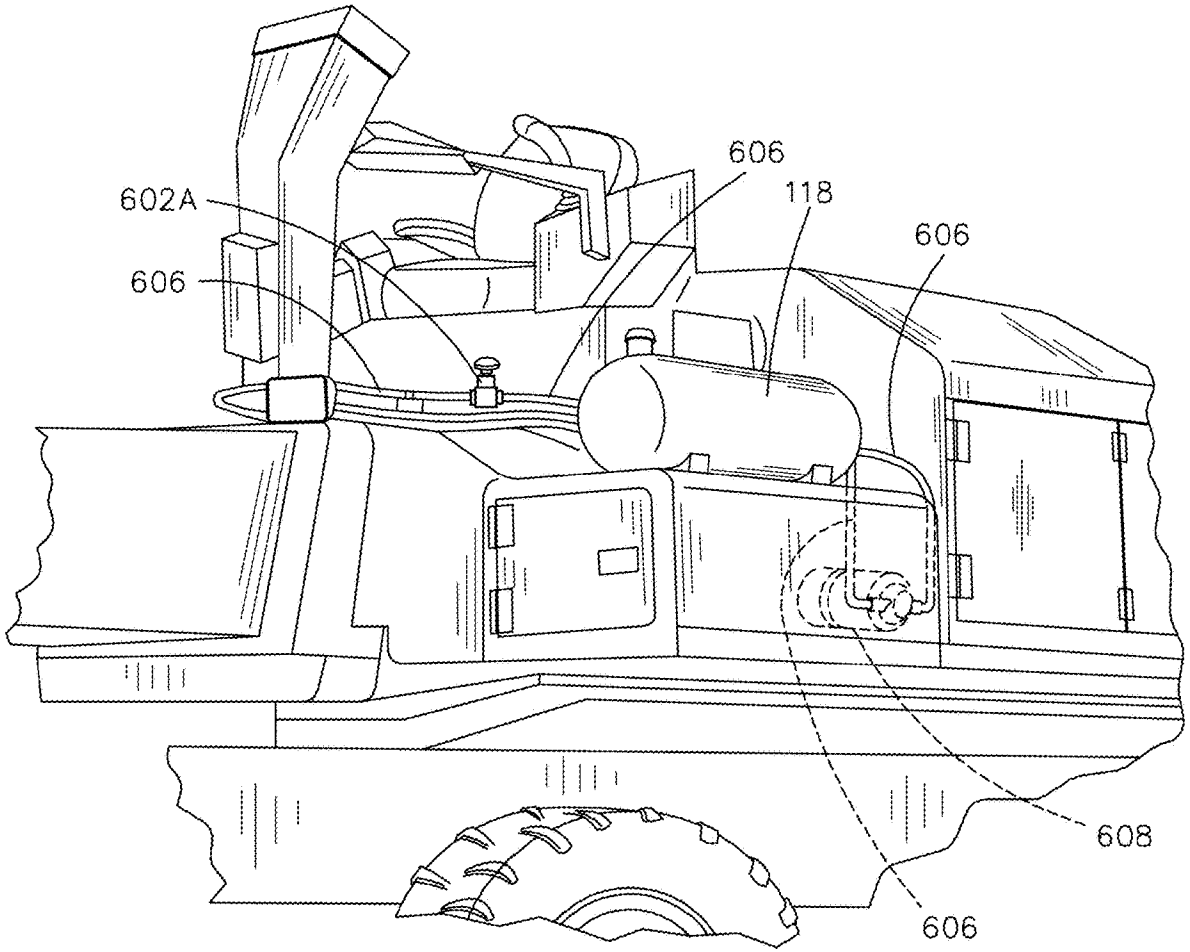
FIG. 6A is a view of a portion of an exemplary chemical spray system of the boom screed machine of FIG. 1.
Figure 6B:
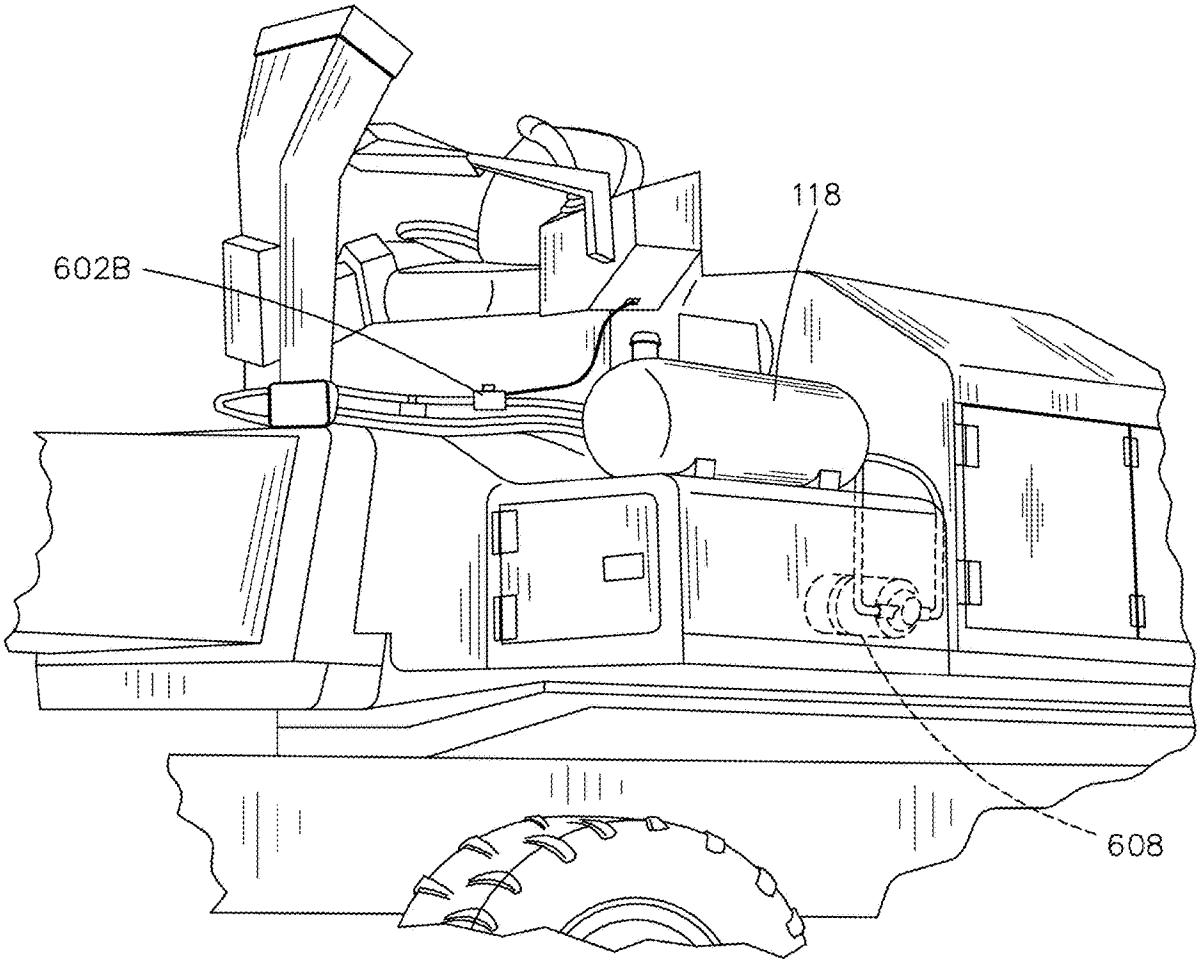
FIG. 6B is a view of a portion of an exemplary chemical spray system of the boom screed machine of FIG. 1.

Referring now to FIGS. 6A and 6B, the chemical spray system of the boom screed machine 100 may include the chemical tank 118, a pump 608, piping 606, a pressure regulating valve (e.g., a pressure reducing needle valve 602A or a pressure regulating control valve 602B).

The chemical tank 118 may be configured to store premixed chemical spray fluid, such as an evaporation retardant. The chemical tank 118 may be configured to supply the chemical spray fluid to the pump 608 via piping 606. The pump 608 may be configured to pump the chemical spray fluid through the piping 606, the hose 202, the piping 212, and the spray heads 112. The pump 608 may be controlled (e.g., activated and deactivated) by the pump user input switch 506 and/or a controller (e.g., 802). The pressure regulating valve (e.g., a pressure reducing needle valve 602A or a pressure regulating control valve 602B) may be configured to adjustably control the flow and/or pressure of the chemical spray fluid through the piping 606, 212. In some embodiments, the pressure regulating control valve 602B may be controlled (e.g., so as to adjust a flow rate) by a user input control device or a controller (e.g., 802). The piping 606 may be coupled to the hose 202. While the piping 606 is shown and described as piping, in some embodiments, the piping 606 may be implemented as any suitable tubing, such as piping or hose. In some embodiments, the pressure regulating valve is located on the platform assembly 120 and near (e.g., within 1 meter of, within 2 meters of) the operator seat 116 and the tank 118 such that the operator of the boom screed machine 102 may adjust the pressure regulating valve (e.g., a pressure reducing needle valve 602A) while remaining on the platform assembly 120.

While FIGS. 6A and 6B exemplarily includes elements as shown, in some embodiments, one or more of the elements of the boom screed machine 100 may be omitted, or the boom screed machine 100 may include other elements. For example, in some embodiments, the chemical spray system may include a different number of tanks. Additionally, while FIGS. 6A and 6B exemplarily includes the depicted arrangement of elements as shown, in some embodiments, one or more of the elements of the boom screed machine 100 may have a different arrangement.

Figure 7A:
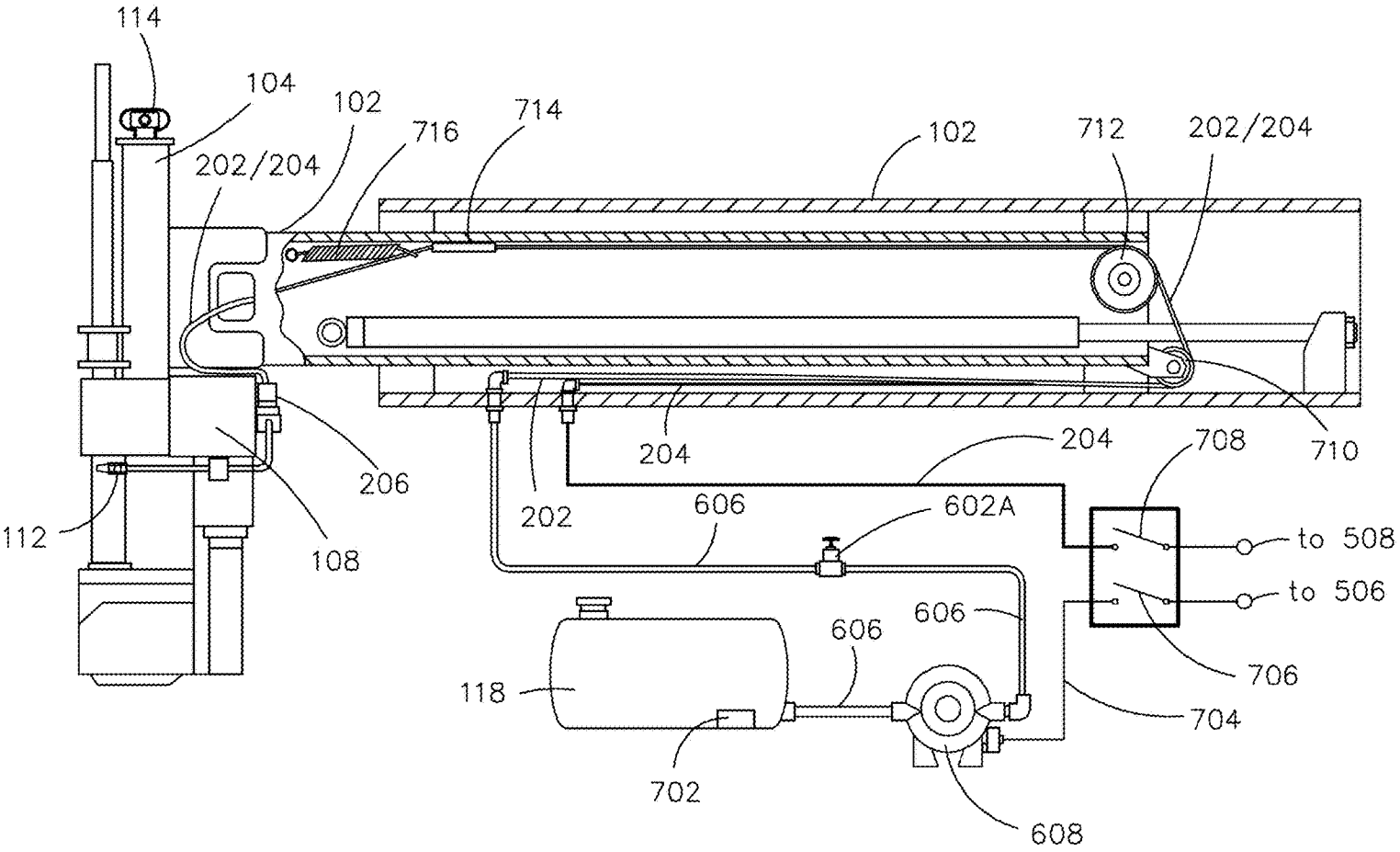
FIG. 7A is a diagram of an exemplary chemical spray system of the boom screed machine of FIG. 1.

Referring now to FIG. 7A, a diagram of the chemical spray system of the boom screed machine 100 of an exemplary embodiment is depicted.

The chemical spray system of the boom screed machine 100 may include a reel system. The reel system may be implemented in the boom 102 and may include wheels 710, 712 (e.g., grooved wheels), a cable pull device 714, and a tension spring 716. Grooves of the wheels 710, 712 may be configured to accommodate the hose 202 and the cable 204 such that the hose 202 and the cable 204 may roll around the grooved wheels 710, 712 as the boom 102 is extended or retracted. The cable pull device 714 may be implemented as a sleeve around one or more of the hose 202 and the cable 204 and may be attached to the tension spring 716. The tension spring 716 may be attached to the boom 102 and the cable pull device 714 and may be configured to apply tension to the hose 202 and the cable 204 to keep the hose 202 and the cable 204 taut within the boom 102. The reel system may be configured to allow the hose 202 and the cable 204 to extend or retract through the boom 102 as the boom 102 is extended or retracted while keeping the hose 202 and the cable 204 taut within the boom 102.

Additionally, in some embodiments, the chemical spray system of the boom screed machine 100 may include one or more relays, such as relays 706, 708. The relays 706, 708 may be coupled via wires to the pump control switch 506 and the spray control switch 508, respectively, and/or a controller (e.g., 802). The relay 706 may be configured to open and close a circuit for providing power to the pump 608 so as to activate and deactivate the pump 608. The relay 708 may be configured to open and close a circuit for providing power to the solenoid valve 206 so as to open and close the solenoid valve 206.

Additionally, in some embodiments, the chemical tank 118 may include a tank sensor 702 configured to measure an amount of fluid within the chemical tank 118. The tank sensor may be coupled to a controller (e.g., 802), which may be configured to output an indication (e.g., via the display 504) regarding an amount of fluid in the tank 118.

Figure 7B:
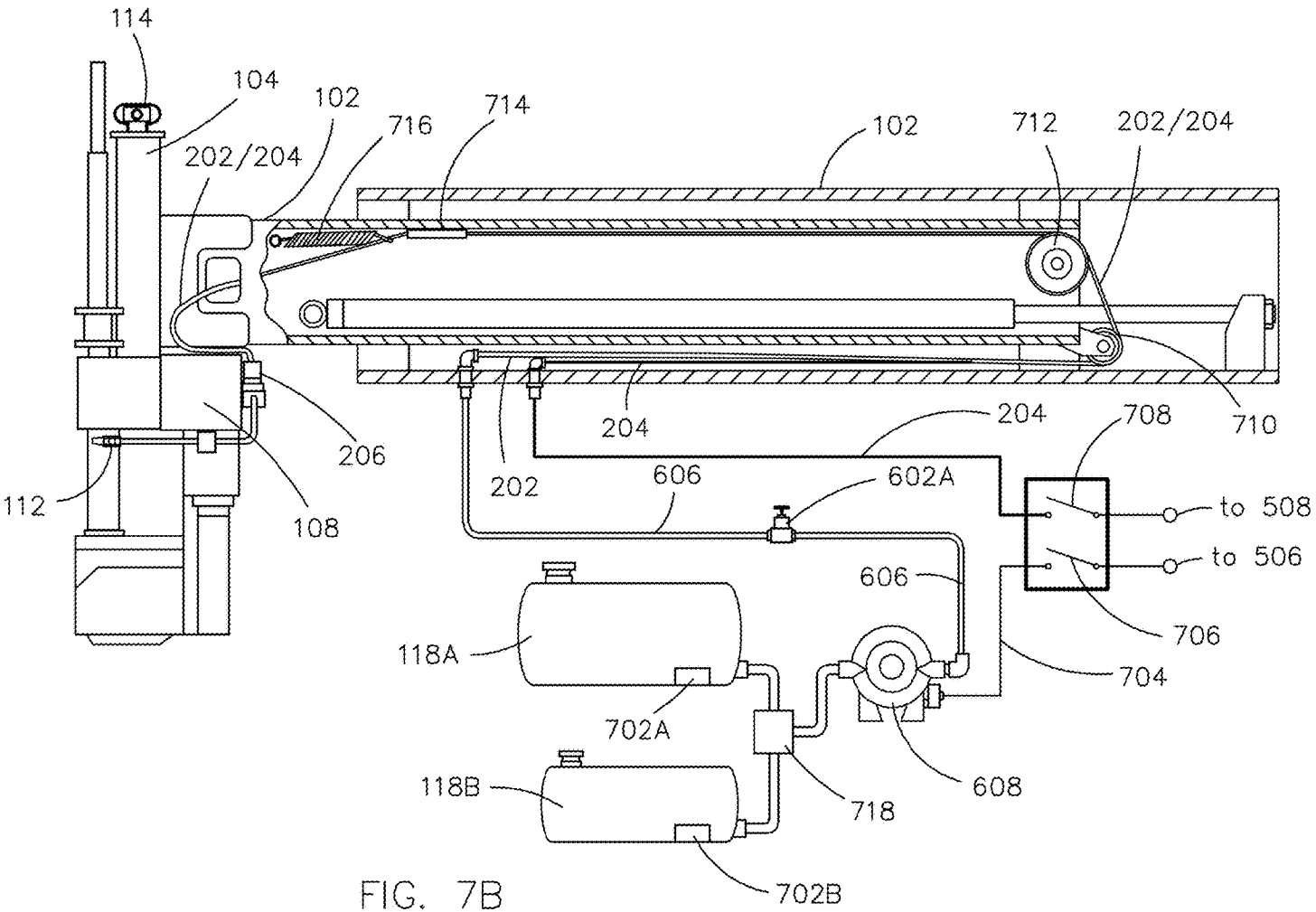
FIG. 7B is a diagram of an exemplary chemical spray system of the boom screed machine of FIG. 1.

Referring now to FIG. 7B, a diagram of a chemical spray system of the boom screed machine 100 of an exemplary embodiment is depicted. The chemical spray system depicted in FIG. 7B may be implemented similarly and function similarly to the chemical spray system depicted in FIG. 7A except that the chemical spray system depicted in FIG. 7B may include a water tank 118A, a chemical spray component solution tank 118B, and a mixing valve 718. The water tank 118A may be configured to store water. The chemical spray component solution tank 118B may be configured to store a chemical spray component solution, such as a concentrated evaporation retardant component solution. The mixing valve 718 may be configured to receive the water from the water tank 118A and the chemical spray component solution from the chemical spray component solution tank 118B. The mixing valve 718 may be configured to mix the water and the chemical spray component solution according to a predetermined ratio into the chemical spray fluid. For example, the mixing valve 718 may be configured to mix the water and the chemical spray component solution with a ratio of approximately (e.g., +/−10%) 9 parts water to 1 part chemical spray component solution. The mixing valve 718 may be configured to provide the mixed chemical spray fluid to the pump 608 via piping 606.

The water tank 118A and the chemical spray component solution tank 1186 may include tanks sensors 702A, 702B, respectively, which may be implemented similarly and function similarly to tank sensor 702.

Figure 8:
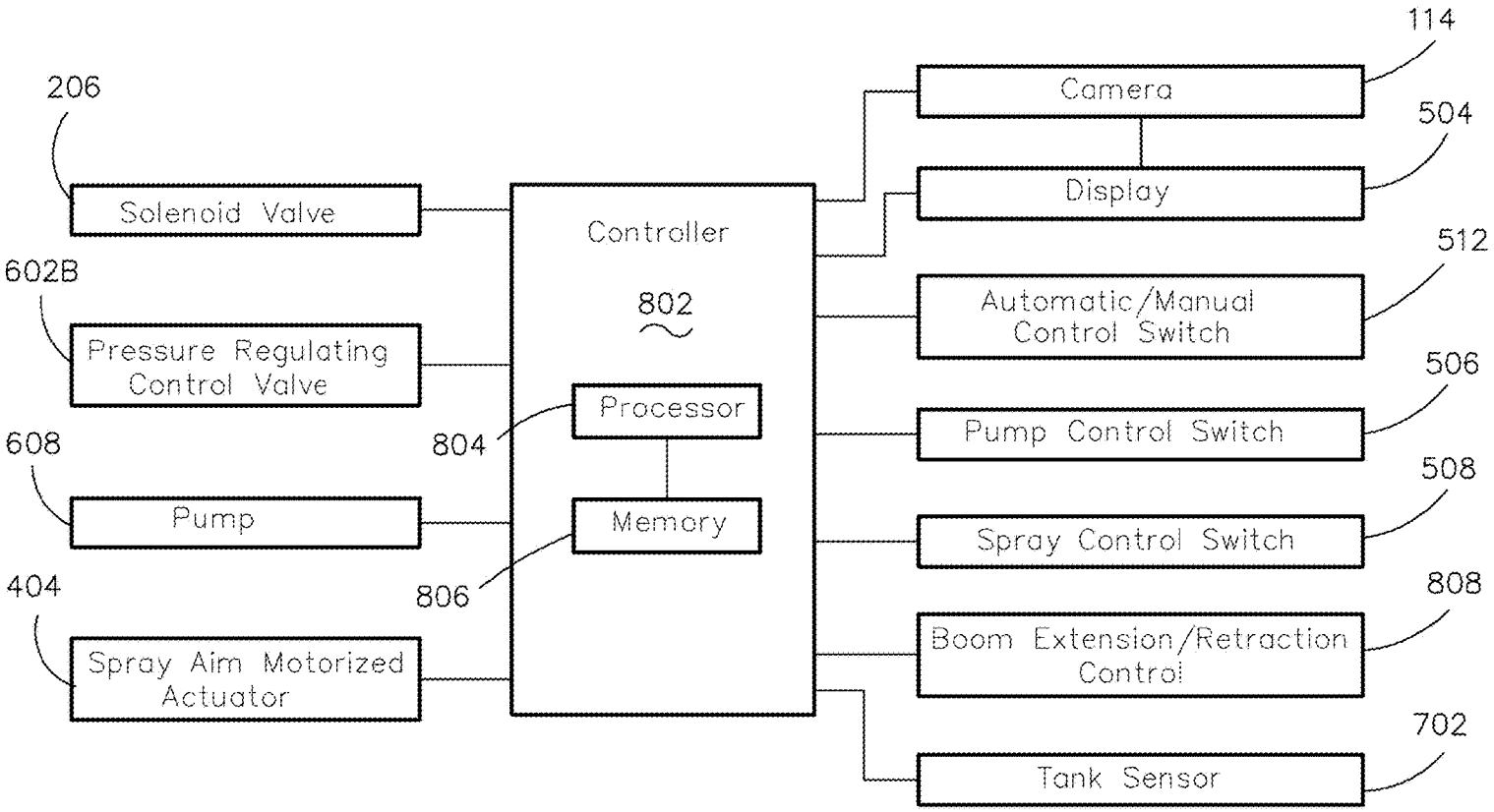
FIG. 8 is a view of an exemplary control system for the chemical spray system of the boom screed machine of FIG. 1.

Referring now to FIG. 8, a control system for the chemical spray system of the boom screed machine 102 may include any or all of the solenoid valve 206, the pressure regulating control valve 602B, the pump 608, the spray aim motorized actuator 404, at least one controller (e.g., controller 802), the camera 114, the display 504, the automatic/manual control switch 512, the pump control switch 506, the spray control switch 508, a boom extension/retraction control 808, one or more tank sensors (e.g., 702, 702A, and/or 702B), and the relays 706, 708, some or all of which may be communicatively coupled. The controller 802 may be configured to control any or all of the solenoid valve 206, the pressure regulating control valve 602B, the pump 608, the spray aim motorized actuator 404, the camera 114, the display 504, the automatic/manual control switch 512, the pump control switch 506, the spray control switch 508, the boom extension/retraction control 808, the one or more tank sensors (e.g., 702, 702A, and/or 702B), and the relays 706, 708.

The controller 802 may include at least one processor 804 and memory 806, as well as other components, equipment, and/or devices commonly included in a computing device, all of which may be communicatively coupled. The controller 802 may be configured to receive data or signals from any or all of the solenoid valve 206, the pressure regulating control valve 602B, the pump 608, the spray aim motorized actuator 404, the camera 114, the display 504, the automatic/manual control switch 512, the pump control switch 506, the spray control switch 508, the boom extension/retraction control 808, the relays 706, 708, and the one or more tank sensors (e.g., 702, 702A, and/or 702B). The controller 802 may be configured to receive data or signals from any or all of the solenoid valve 206, the pressure regulating control valve 602B, the pump 608, the spray aim motorized actuator 404, the camera 114, the display 504, the automatic/manual control switch 512, the pump control switch 506, the spray control switch 508, the boom extension/retraction control 808, the relays 706, 708, and the one or more tank sensors (e.g., 702, 702A, and/or 702B). The controller 802 may be programmed to and/or configured to execute instructions to perform any of the functionality of the chemical spray system, as disclosed throughout. The processor 804 may be configured to run various software applications or computer code stored (e.g., maintained) in a non-transitory computer-readable medium (e.g., at least one computer-readable medium implemented as hardware; e.g., at least one non-transitory processor-readable medium, at least one memory 806 (e.g., at least one nonvolatile memory, at least one volatile memory, or a combination thereof; e.g., at least one random-access memory, at least one flash memory, at least one read-only memory (ROM) (e.g., at least one electrically erasable programmable ROM (EEPROM), at least one on-processor memory (e.g., at least one on-processor cache, at least one on-processor buffer, at least one on-processor flash memory, at least one on-processor EEPROM, or a combination thereof), or a combination thereof), at least one storage device (e.g., at least one hard-disk drive, at least one tape drive, at least one solid-state drive, at least one flash drive, at least one readable and/or writable disk of at least one optical drive configured to read from and/or write to the at least one readable and/or writable disk, or a combination thereof), or a combination thereof) and configured to execute various instructions or operations, such as disclosed throughout. Additionally, for example, the controller 802 and/or the processor 804 may be implemented as special purpose computers and/or special purpose processors configured (e.g., programmed) to execute instructions for performing any or all of the operations disclosed throughout. In some embodiments, the boom screed machine 100 may include any suitable number of controllers 802 and/or processors 804.

While the control system for the chemical spray system of the boom screed machine 100 has been exemplarily depicted as being implemented as including a single controller 802, in some embodiments, some or all of the control system may be implemented as a single integrated control system or device, as any number of controllers, as any number of integrated and/or partially integrated systems and/or devices, or as separate control systems or devices.

As will be appreciated from the above, embodiments of the inventive concepts disclosed herein may be directed to a kit and boom screed machine 100 including a chemical spray system.

As used throughout and as would be appreciated by those skilled in the art, "at least one non-transitory computer-readable medium" may refer to as at least one non-transitory computer-readable medium (e.g., memory 806; e.g., at least one computer-readable medium implemented as hardware; e.g., at least one non-transitory processor-readable medium, at least one memory (e.g., at least one nonvolatile memory, at least one volatile memory, or a combination thereof; e.g., at least one random-access memory, at least one flash memory, at least one read-only memory (ROM) (e.g., at least one electrically erasable programmable ROM (EEPROM), at least one on-processor memory (e.g., at least one on-processor cache, at least one on-processor buffer, at least one on-processor flash memory, at least one on-processor EEPROM, or a combination thereof), or a combination thereof), at least one storage device (e.g., at least one hard-disk drive, at least one tape drive, at least one solid-state drive, at least one flash drive, at least one readable and/or writable disk of at least one optical drive configured to read from and/or write to the at least one readable and/or writable disk, or a combination thereof), or a combination thereof.

As used throughout, "at least one" means one or a plurality of; for example, "at least one" may comprise one, two, three, . . . , one hundred, or more. Similarly, as used throughout, "one or more" means one or a plurality of; for example, "one or more" may comprise one, two, three, . . . , one hundred, or more. Further, as used throughout, "zero or more" means zero, one, or a plurality of; for example, "zero or more" may comprise zero, one, two, three, . . . , one hundred, or more.

In the present disclosure, the methods, operations, and/or functionality disclosed may be implemented as sets of instructions or software readable by a device. Further, it is understood that the specific order or hierarchy of steps in the methods, operations, and/or functionality disclosed are examples of exemplary approaches. Based upon design preferences, it is understood that the specific order or hierarchy of steps in the methods, operations, and/or functionality can be rearranged while remaining within the scope of the inventive concepts disclosed herein. The accompanying claims may present elements of the various steps in a sample order, and are not necessarily meant to be limited to the specific order or hierarchy presented.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. A boom screed machine including a chemical spray system, comprising:

a platform assembly;

a boom configured to extend and retract, the boom being coupled to the platform assembly;

a vertical column coupled to an end of the boom;

a plow head crossbar coupled to the vertical column;

a plow head coupled to the plow head crossbar, the plow head configured to smooth and level wet concrete when the boom is extended;

at least one tank implemented in or on the platform assembly;

a pump implemented in or on the platform assembly;

platform assembly tubing connecting the tank to the pump;

a pressure regulating valve connected to the platform assembly tubing, the pressure regulating valve configured to control a rate of a flow through the platform assembly tubing;

a chemical spray fluid hose coupled to the platform assembly tubing, the chemical spray fluid hose passing through the boom;

a reel system implemented in the boom and configured to accommodate the chemical spray fluid hose;

plow head crossbar tubing mounted to the plow head crossbar and coupled to the chemical spray fluid hose;

a solenoid valve connected to the plow head crossbar tubing, the solenoid valve configured to open and close a flow through the plow head crossbar tubing; and at least one spray head coupled to the plow head crossbar tubing and configured to spray chemical spray fluid onto level and smooth wet concrete, wherein the pump is configured to receive the chemical spray fluid and pump the chemical spray fluid through the platform assembly tubing, the chemical spray fluid hose, the plow head crossbar tubing, and the at least one spray head when the solenoid valve is open and the pump is activated.

2. The boom screed machine including the chemical spray system of claim 1, further comprising:

a camera configured to capture video of wet concrete in front of the plow head; and a display communicatively coupled to the camera, the display configured to present the video to an operator of the boom screed machine.

3. The boom screed machine including the chemical spray system of claim 2, wherein camera is mounted to the vertical column.

4. The boom screed machine including the chemical spray system of claim 1, further comprising:

an operator seat mounted on the platform assembly, wherein the pressure regulating valve is implemented as a pressure reducing needle valve, wherein the pressure reducing needle valve is located within 2 meters of the operator seat.

5. The boom screed machine including the chemical spray system of claim 1, wherein the pressure regulating valve is implemented as a pressure regulating control valve.

6. The boom screed machine including the chemical spray system of claim 1, wherein that at least one spray head comprises at least two spray heads, wherein the at least two spray heads are configured to spray the chemical spray fluid onto the level and smooth wet concrete with a coverage spanning a width of the level and smooth wet concrete.

7. The boom screed machine including the chemical spray system of claim 1, further comprising:

a first relay;

a pump user input device coupled to the first relay, the pump user input device configured to activate and deactivate the pump;

a second relay; and a spray user input device coupled to the second relay, the spray user input device configured to open and close the solenoid valve, wherein the chemical spray system is configured to spray the chemical spray fluid through the at least one spray head when the solenoid valve is open and the pump is activated.

8. The boom screed machine including the chemical spray system of claim 1, further comprising:

a first relay;

a second relay; and at least one user input device coupled to the first relay and the second relay, the at least one user input device configured to activate and deactivate the pump and configured to open and close the solenoid valve, wherein the chemical spray system is configured to spray the chemical spray fluid through the at least one spray head when the solenoid valve is open and the pump is activated.

9. The boom screed machine including the chemical spray system of claim 1, further comprising:

a control system configured to control operation of the chemical spray system.

10. The boom screed machine including the chemical spray system of claim 9, wherein the control system comprises a controller configured to:

activate and deactivate the pump; and open and close the solenoid valve, wherein the chemical spray system is configured to spray the chemical spray fluid through the at least one spray head when the solenoid valve is open and the pump is activated.

11. The boom screed machine including the chemical spray system of claim 10, wherein the controller is further configured to:

activate the pump when the boom is retracting; and open the solenoid valve when the boom is retracting, wherein the chemical spray system is configured to spray the chemical spray fluid through the at least one spray head when the boom is retracting.

12. The boom screed machine including the chemical spray system of claim 11, wherein the controller is further configured to:

deactivate the pump when the boom is extending; and close the solenoid valve when the boom is extending.

13. The boom screed machine including the chemical spray system of claim 11, wherein the control system is configured to operate in an automatic mode and a manual mode.

14. The boom screed machine including the chemical spray system of claim 1, further comprising a mixing valve, wherein the at least one tank comprises at least two tanks including a water tank configured to store water and a chemical spray component solution tank configured to store concentrated chemical spray component solution, wherein the mixing valve is configured to mix the water and the concentrated chemical spray component solution into the chemical spray fluid.

15. The boom screed machine including the chemical spray system of claim 1, wherein the chemical spray fluid is an evaporation retardant.

16. The boom screed machine including the chemical spray system of claim 1, wherein the each of the at least one spray head is adjustable to change an aim of each of the at least one spray head.

17. The boom screed machine including the chemical spray system of claim 1, further comprising:

at least one motorized actuator, each of the at least one motorized actuator configured to adjust an aim of one of the at least one spray head.

* * * * *